US007743528B2

(12) United States Patent
Lin

(10) Patent No.: US 7,743,528 B2
(45) Date of Patent: Jun. 29, 2010

(54) DEHYDRATING DEVICE

(75) Inventor: Chang-I Lin, Taoyuan Hsien (TW)

(73) Assignee: Dikai International Enterprise Co., Ltd., Taoyuan Hsien (TW)

( * ) Notice: Subject to any disclaimer, the term of this patent is extended or adjusted under 35 U.S.C. 154(b) by 0 days.

(21) Appl. No.: 12/056,586

(22) Filed: Mar. 27, 2008

(65) Prior Publication Data

US 2009/0151399 A1 Jun. 18, 2009

(30) Foreign Application Priority Data

Dec. 18, 2007 (TW) ..... 96221538 U

(51) Int. Cl.
*F26B 17/30* (2006.01)

(52) U.S. Cl. ..... 34/58

(58) Field of Classification Search ..... 34/58, 34/312, 318, 322; 15/311, 260, DIG. 9
See application file for complete search history.

(56) References Cited

U.S. PATENT DOCUMENTS 2,392,933 A * 1/1946 Mallory ..... 123/53.5
2,625,704 A * 1/1953 Cudy ..... 15/311
3,065,604 A * 11/1962 Randol et al. ..... 60/570
5,274,877 A * 1/1994 Morad et al. ..... 15/262

FOREIGN PATENT DOCUMENTS

JP 03055022 A * 3/1991

* cited by examiner

*Primary Examiner*—Jiping Lu
(74) *Attorney, Agent, or Firm*—Rosenberg, Klein & Lee

(57) ABSTRACT

A dehydrating device comprises a tappet unit, a transmission unit and a rotation unit, wherein the rotation unit comprises a bearing member and a transmission shaft. A aquiferous member is disposed in the bearing member, and then the operation of the tappet unit is beginning. The tappet unit then mechanically drives the transmission unit and the rotation unit so as to dewater the aquiferous member.

9 Claims, 6 Drawing Sheets

DEHYDRATING DEVICE

BACKGROUND OF THE INVENTION

1. Field of the Invention

The present invention generally relates to a dehydrating device, more particular to a device that comprises a tappet unit, a transmission unit and a rotation unit, and dewaters an aquiferous member while the tappet unit is operated to mechanically drive the transmission unit and the rotation unit.

2. Description of the Prior Art

Nowadays, mop is a major tool for cleaning floor. One of prior mops is consisted of a handle and some cloths connected to the one end of the handle. For dewatering on the purposes of fast and labor-saving, the most common use is to adopt a bucket having a squeezing tool to press the cloths for dewatering.

Alternatively, another prior rotational mop is consisted of a handle, a turntable and some cloths. The one end of the handle is pivotally connected to the center of the turntable. The cloths are distributed on the lower surface of the turntable. While the mop is in operation, the turntable is rotated to increase the effect of cleaning. Due to that the cloths distributed on the lower surface of the turntable are not long enough, the cloths are hardly to be combined as a fascination, so that the bucket having the squeezing tool cannot be properly used.

Thus, how to develop a dehydrating device that effectively and fast dewaters the rotational mop is an important issue to the persons who are skilled in the related arts.

SUMMARY OF THE INVENTION

The primary objective of the present invention is to provide a dehydrating device for fast dewatering an aquiferous member.

To approach above objective, the dehydrating device of the present invention is to dewatering the aquiferous member and comprises: a body, which has an accommodation and an installation portion, a partition is disposed between the accommodation and the installation portion; a rotation unit, which has a bearing member disposed in the accommodation, the bearing member accommodates the aquiferous member; and a transmission shaft, which is disposed in the installation portion and connected to the bearing member; and a tappet unit, which is connected to the transmission unit; wherein the tappet unit mechanically drives the transmission unit, and the transmission unit drives the rotation unit to rotate in order to dewatering the aquiferous member.

The advantages of the present invention are described as below. A user takes an aquiferous member as a rotational mop into the bearing member of the rotation unit. The rotation unit is driven to fast rotate by easily handling the tappet unit so as to drive the rotational mop very quickly. Continuously the water in the rotational mop will be flung out in order to approach the objective of fast dewatering. The present invention adopts a mechanical device without additional electric power so as to save power. Further, the applications of the present invention can be used as towels, socks, dishcloths, etc.

Other and further features, advantages and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms. Like numerals refer to like parts throughout the disclosure.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

Figure 1:
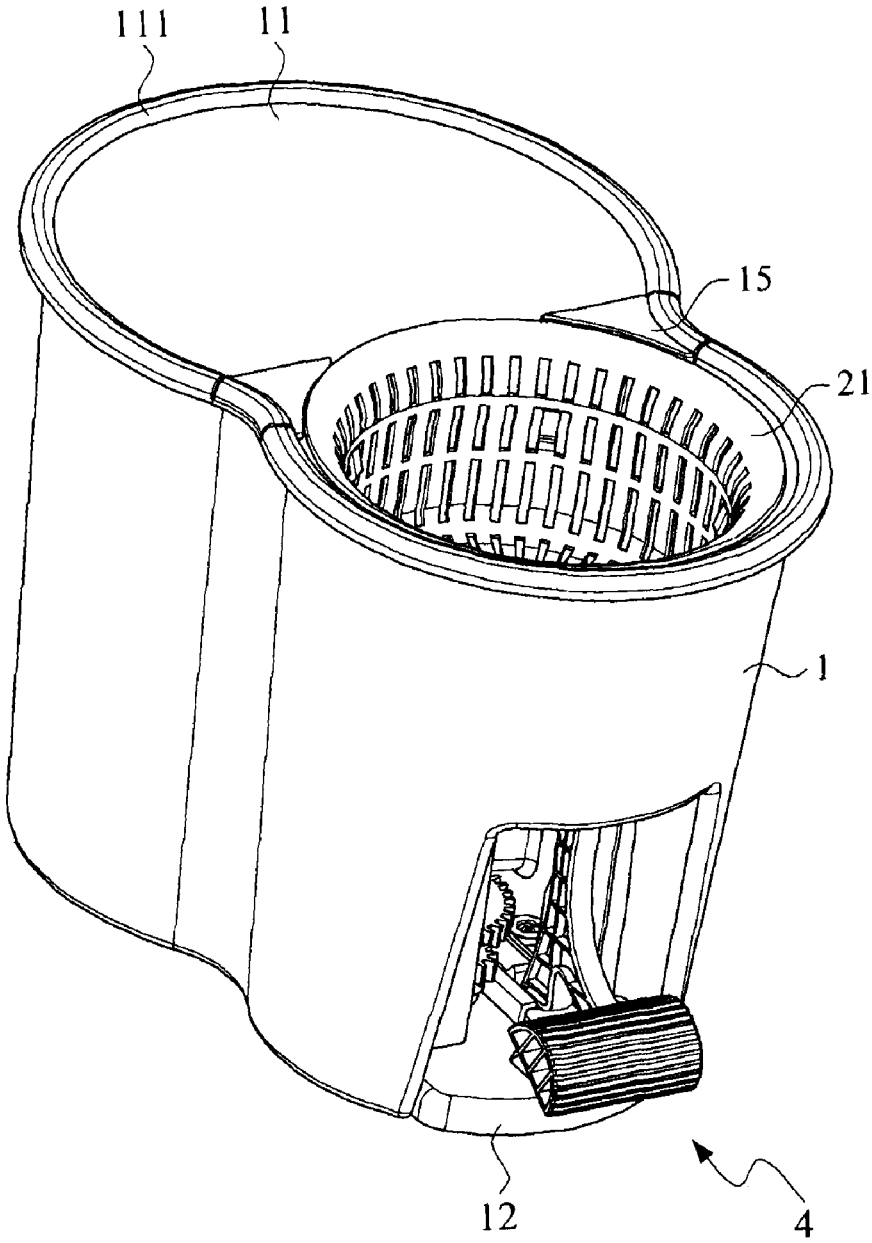
FIG. 1 illustrates a schematic 3-D view of a dehydrating device of the present invention.
Figure 2:
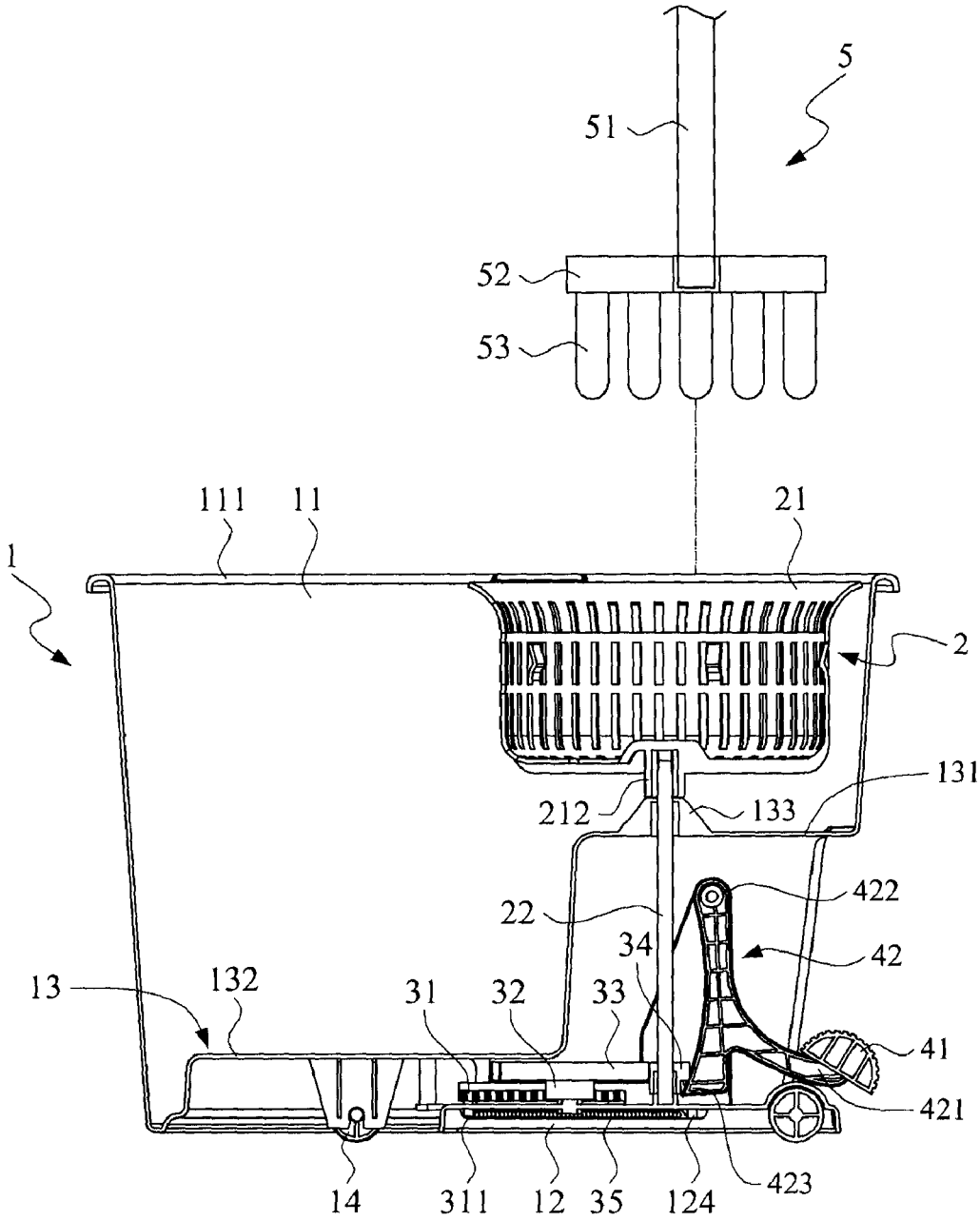
FIG. 2 illustrates a schematic sectional view of an aquiferous member and the dehydrating device of the present invention.
Figure 3:
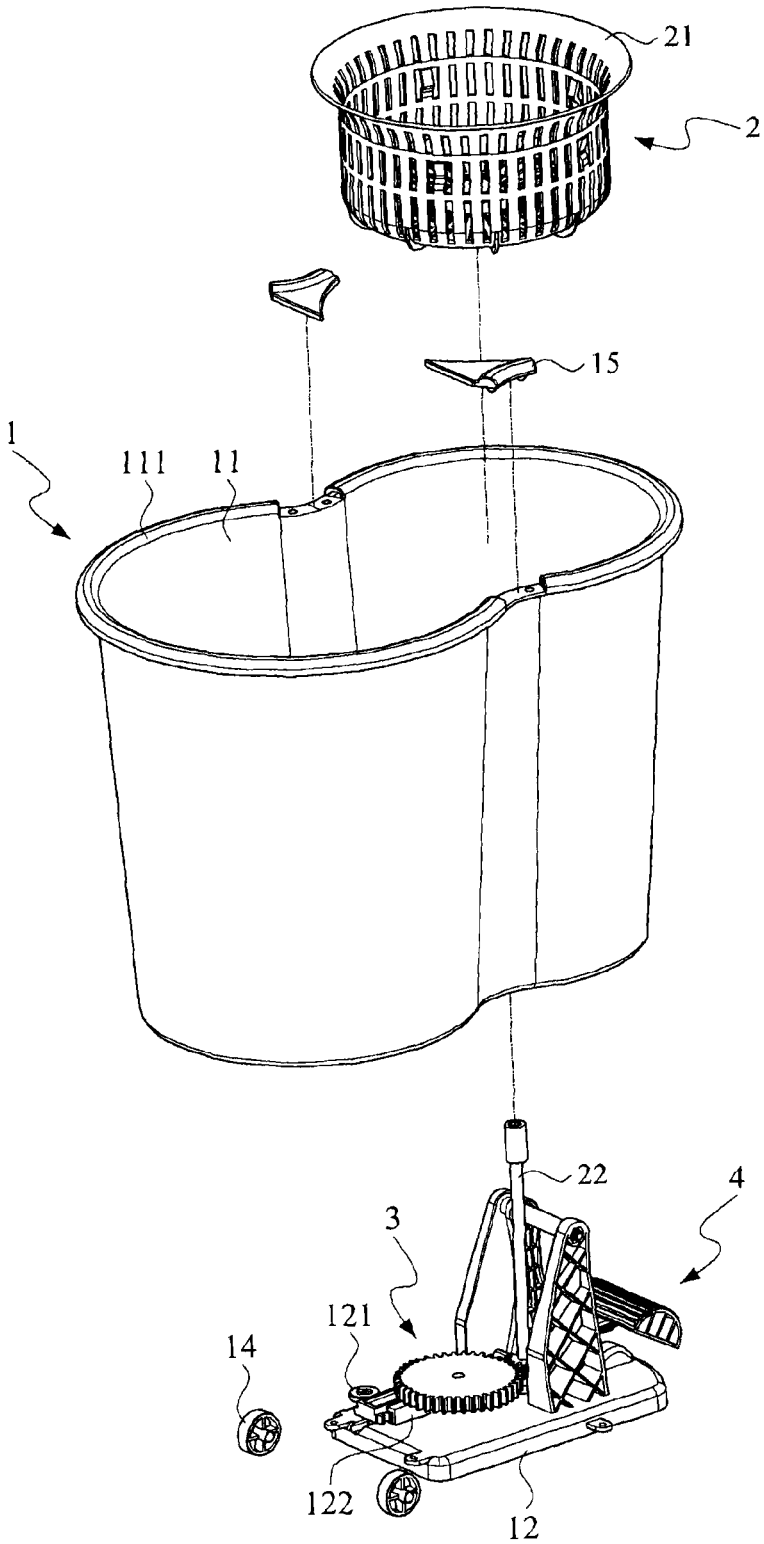
FIG. 3 illustrates a schematic partial exploded view of the dehydrating device of the present invention.
Figure 4:
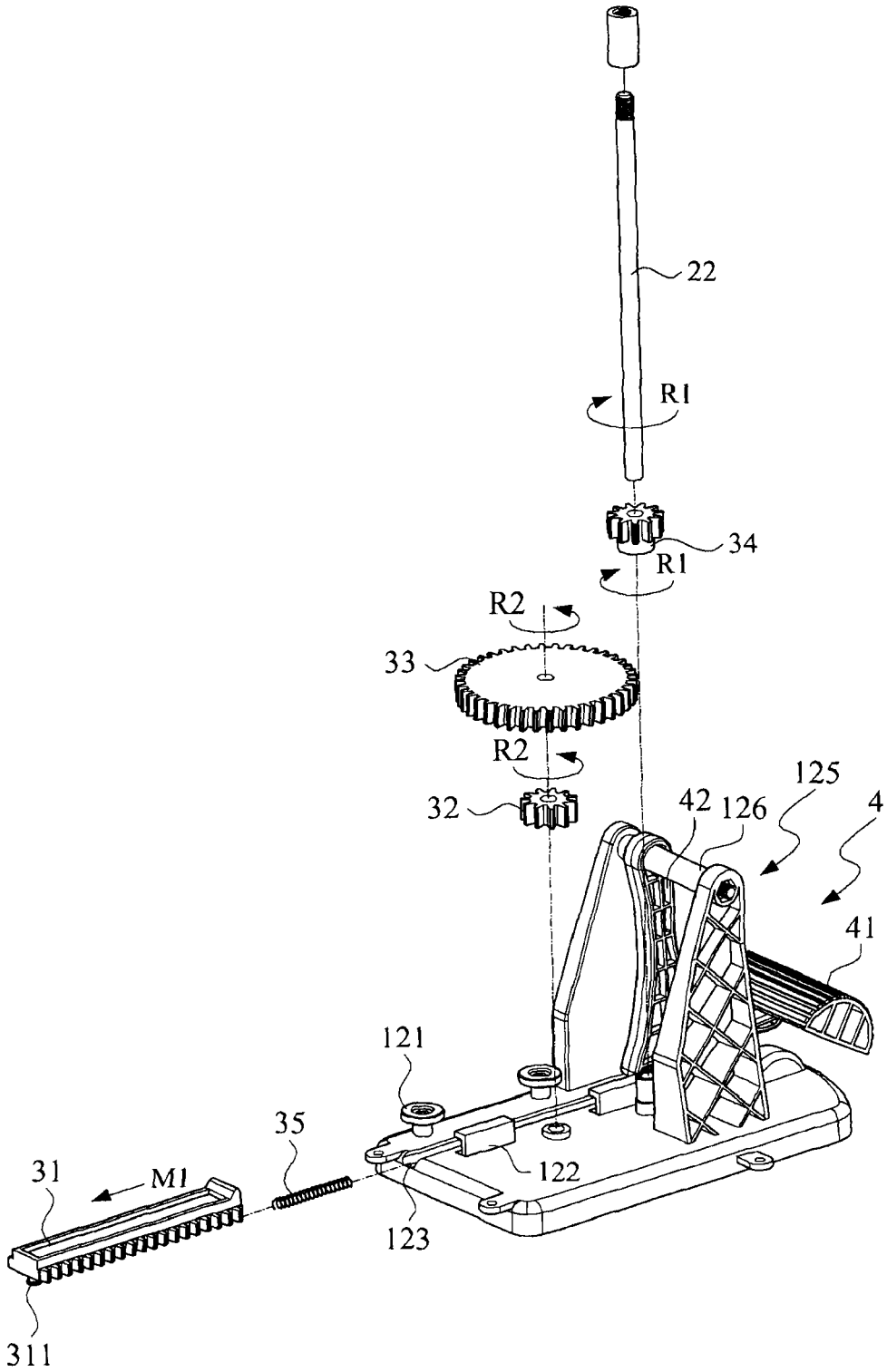
FIG. 4 illustrates a schematic partial exploded view of the dehydrating device of the present invention in more detail.

The present invention is a dehydrating device, which is able to dewater an aquiferous member 5. With reference to FIG. 1 to FIG. 4, the dehydrating device includes a body 1, a rotation unit 2, a transmission unit 3, and a tappet unit 4.

The body 1 is shape as a cylindrical structure, and the bottom of the body 1 has at least one roller 14 for the movement of the body 1. The body 1 has an accommodation 11 and an installation portion 12, a partition 13 is disposed between the accommodation 11 and the installation portion 12. The top of the accommodation 11 is an open 111 for the aquiferous member 5 and water entering into. The partition 13 is to avoid the leakage of the water in the accommodation 11 through the bottom of the body 1. The partition 13 has a higher portion 131 and a lower portion 132 in order to let the water flowing to the higher portion 131 be gathered up to the lower portion 132. The higher portion 131 of the partition 13 has a convex 133. The installation portion 12 is disposed at the bottom of the body 1 or below the higher portion 131 of the partition 13. The installation portion 12 is either integrated with the body 1 or dismantled/assembled with the body 1. Further that, the installation portion 12 can be added at least one roller 14 for easy movement.

The rotation unit 2 has a bearing member 21 and a transmission shaft 22. The bearing member 21 is disposed in the accommodation 11, and the center of the bottom of the bearing member 21 has a protrusion 212, which touches the convex 133 of the partition 13. The bearing member 21 can be as a bearing basket with the open 111 so as to accommodate the aquiferous member 5, or a holding device in order to hold the aquiferous member 5. For the preferred embodiment, a suitable way is that a baffle 15 is disposed at the open of the body 1 in order to avoid the dumping or falling off of the bearing member 21. The transmission shaft 22 is disposed in the installation portion 12, and the one end of the transmission shaft 22 is through the partition 13, so the transmission shaft 22 is able to connect the protrusion 212 disposed at the bottom of the bearing member 21. The other end of the transmission shaft 22 is pivotally connected to the installation portion 12.

The transmission unit 3 is disposed in the installation portion and connected to the transmission shaft 22. The transmission unit 3 is consisted of a set of gears. The transmission unit 3 includes a gear row 31, a first gear 32, a second gear 33, a one-way gear 34, and a flexible member 35, and the gear row 31 and the first gear 32 are engaged each other, the installation portion 12 further has a guide wheel 121 and a guide rail 122, the guide wheel 121 and the guide rail 122 are disposed at the two sides of the gear row 31 in order to limit the gear row 31 moving along a predetermined direction. The guide wheel 121 functions to smoothly move the gear row 31.

The flexible member 35 can be a spring or a rubber belt. The bottom of the gear row 31 has a pillar 311. An upper surface of installation portion 12 between the guide wheel 121 and the guide rail 122 has a slot 123, a pillar 124 is disposed in the slot 123. The flexible member 35 is disposed in the slot 123, and the one end of the flexible member 35 is fixed at the pillar 311 of the gear row 311, another end of the flexible member 35 is fixed at the pillar 124 of the installation portion 12. Thus, while moving the gear row 31, the flexible member 35 provides an elastic force in order to return the gear row 31 to an original position itself.

The first gear 32 and the second gear 33 are coaxial, the one-way gear 34 and the transmission shaft 22 are coaxial, and the one-way gear 34 and the second gear 33 are engaged each other. Therefore, while moving the gear row 31, the first gear 32, the second gear 33 and the one-way gear 34 are driven in order for rotation, then the transmission shaft 22 is rotated. The one-way gear 34 is only rotated along a first rotation direction R1 so as to provide a power to make the rotation direction of the transmission shaft 22 be along the first rotation direction R1. The inner structure of the one-way gear 34 is a prior art and will not be described any further. On the other hand, the dimensions of the second gear 33 can be adjusted in order to regulate the rotation speed of the transmission shaft 22.

The tappet unit 4 is connected to the transmission unit 3, wherein the tappet unit 4 has a pedal 41 and a tappet 42. The installation portion 12 further has a brace 125. The brace 125 has an axial rod 126. The pedal 41 is disposed at the first end 421 of the tappet 42, the second end 422 of the tappet 42 is pivotally connected to the axial rod 126 of the brace 125, and the third end 423 of the tappet 42 is touched or connected to the gear row 31 of the transmission unit 3. While the pedal 41 is pressed down, continuously the third end 423 is rotated by means of the tappet 42, and the third end 423 drives the gear row 31 for movement.

Figure 5:
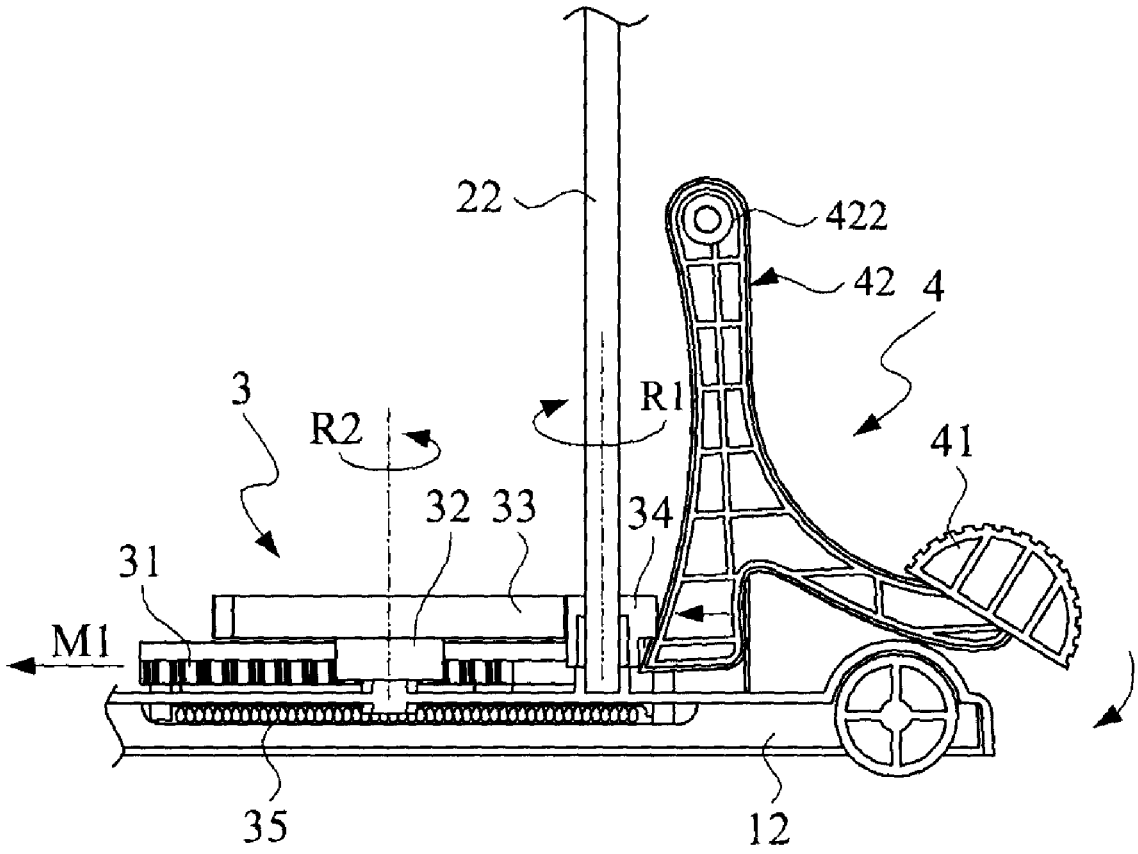
FIG. 5 illustrates a schematic action view of the dehydrating device of the present invention, wherein a pedal is pressed down.
Figure 6:
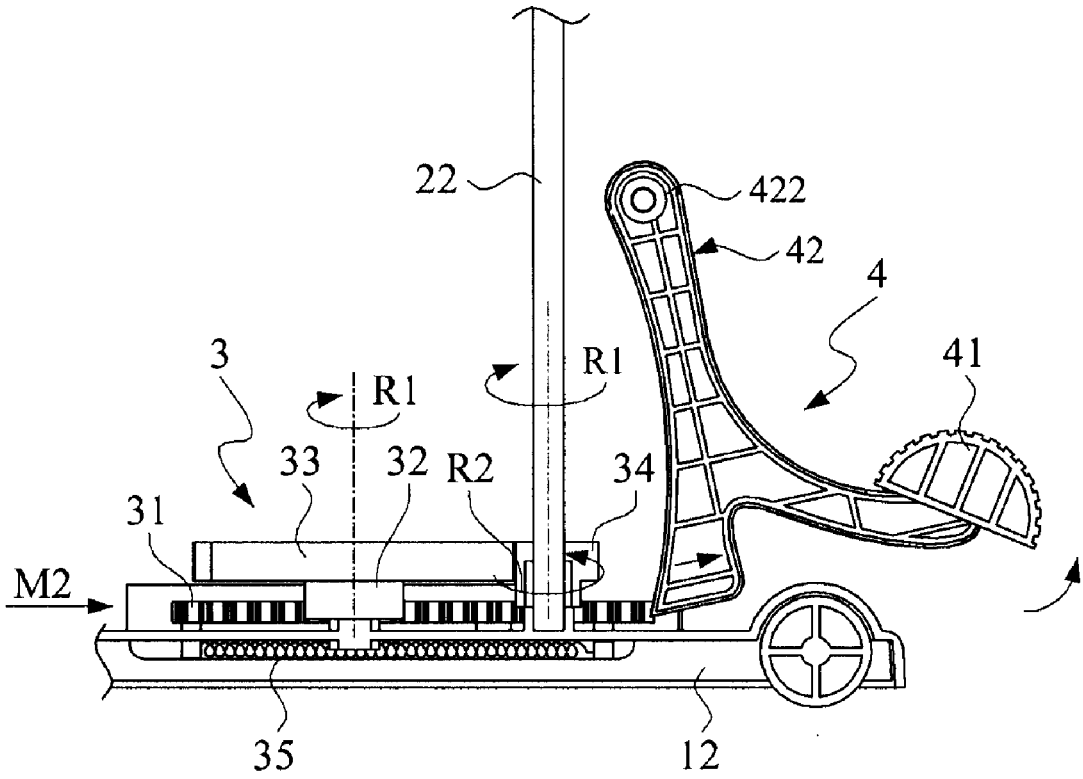
FIG. 6 illustrates a schematic action view of the dehydrating device of the present invention, wherein a pedal is released.

With reference to FIG. 5 and FIG. 6, which are action views of the present invention. First to FIG. 5, while the pedal 41 is pressed down, the second end 422 is then rotated to drive the first row 31 to move along a first moving direction M1, and the flexible member 35 is extended. The gear row 31 drives the first gear 32 to rotate along the second rotation direction R2. Since the second gear 33 and the first gear 32 are coaxial, thus the second gear 33 rotates along the second rotation direction R2 as well. The one-way gear 34 is driven to rotate along the first direction. Therefore the transmission shaft 22 is driven to rotate along the first direction also.

With reference to FIG. 6, while the pedal 41 is released, due to the pulling force of the flexible member 35, the gear row 31 is driven to move along the second direction M2, which is opposite to the first direction M1. The tappet 42 is rotated reversely to lift the pedal 41 up; on the other hand, the gear row 31 simultaneously drives the first gear 32 to rotate along the first rotation direction R1, and the first gear 32 also drives the second gear 33 to rotate along the first rotation direction R1. Constantly the second gear 33 drives the one-way gear 34 to rotate along the second rotation R2, but the one-way gear 34 does not drive the transmission shaft 22 along the second rotation direction R2, so that the transmission shaft 22 maintains its own rotation direction as the first rotation direction R1.

Please refer FIG. 1 to FIG. 6, for the preferred embodiment, the aquiferous member 5, such as the mop, includes a handle 51, a turntable 52 and some cloths 53. The one end of the handle 51 is pivotally connected to the center of the turntable 52. The cloths 53 are distributed on the lower surface of the turntable 52. While dewatering the aquiferous member 5, the turntable 52 and the cloths 53 are disposed in the bearing member 21. Hence, while the operation of the tappet unit 4 is beginning, the tappet unit 4 mechanically drives the transmission unit 3 in order to rotate the rotation unit 2, and further to the turntable 52. The aquiferous member 5 is then dewatered.

Although this invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A dehydrating device for dewatering an aquiferous member and comprising:

a body having an accommodation and an installation portion, a partition being disposed between the accommodation and the installation portion;

a rotation unit comprising:

a bearing member being disposed in the accommodation and accommodating the aquiferous member;

a transmission shaft being disposed in the installation portion and connected to the bearing member;

a transmission unit being disposed in the installation portion and connected to the transmission shaft; wherein said transmission unit is bodily operated;

a tappet unit having a pedal and an integrally formed tappet, said tappet including a first end, and a third end, wherein the third end of said tappet is coupled to said transmission unit and the first end of said tappet is coupled to said pedal;

wherein when said pedal is depressed, said third end pushes said transmission unit in a first direction to mechanically drives the transmission unit, and said transmission unit drives the rotation unit to rotate in order to dewater the aquiferous member; and wherein when said pedal is released, said transmission unit automatically pushes said third end in a reverse direction to said first direction to lift up said pedal, said transmission unit including a one-way gear for meshing with a second gear of said transmission unit to maintain a singular rotational direction of said transmission shaft when said pedal is depressed or released; and wherein when said tappet unit is operating, said aquiferous member is contained within and encircled by said bearing member; and said aquiferous member is dewatered by centrifugal action of said bearing member.

2. The dehydrating device for dewatering the aquiferous member according to claim 1, wherein the transmission unit is consisted of a set of gears.

3. The dehydrating device for dewatering the aquiferous member according to claim 2, wherein all of the shafts of gears constitutes the set of gears and the transmission shaft is parallel to each other.

4. The dehydrating device for dewatering the aquiferous member according to claim 1, wherein the transmission unit comprises a gear row a first gear, and said second gear, and said one-way gear, the gear row in meshing relationship with the first gear, the first gear and the second gear are coaxial, the one-way gear and the transmission shaft are coaxial, the one-way gear in meshing relationship with the second gear, and the third end of said tappet is coupled to the gear row, when the pedal is depressed, the third end pushes the gear row in a first direction to mechanically drive the transmission unit, the one-way gear of the transmission unit drives the rotation unit to rotate in order to dewater the aquiferous member, and wherein when the pedal is released, the gear row pushes the third end of said tappet for lifting the pedal up.

5. The dehydrating device for dewatering the aquiferous member according to claim 4, wherein the installation portion has a guide wheel and a guide rail, the guide wheel and the guide rail are disposed at the two sides of the gear row in order to limit the gear row moving along a predetermined direction.

6. The dehydrating device for dewatering the aquiferous member according to claim 1, wherein the transmission unit further comprises a flexible member, the end of the flexible member is fixed at a gear row, another end is fixed in the installation portion, when the pedal is released, the flexible member pulls back the gear row, and the gear row push the pedal for lifting the pedal up.

7. The dehydrating device for dewatering the aquiferous member according to claim 1, wherein said tappet further includes a second end disposed between said first and third ends, the installation portion has a brace, and said second end of the tappet is pivotally connected to the brace.

8. The dehydrating device for dewatering the aquiferous member according to claim 1, wherein the body has a roller.

9. The dehydrating device for dewatering the aquiferous member according to claim 1, wherein a plurality of cloths and turntable of said aquiferous member are both contained within and encircled by said bearing member; and said aquiferous member is dewatered by centrifugal action of said bearing member.

* * * * *